US010801135B2

(12) United States Patent
Estreicher et al.

(10) Patent No.: US 10,801,135 B2
(45) Date of Patent: Oct. 13, 2020

(54) MULTI-EFFECT WOVEN FABRIC FOR ENERGY HARVESTING AND HEAT MANAGEMENT

(71) Applicant: New York Knitworks, LLC, New York, NY (US)

(72) Inventors: Sidney Samuel Estreicher, Hillsborough, NJ (US); Gabor Stein, New York, NY (US); George Joseph Szekely, Elkins Park, PA (US)

(73) Assignee: NEW YORK KNITWORKS, LLC, New York, NY (US)

( * ) Notice: Subject to any disclaimer, the term of this patent is extended or adjusted under 35 U.S.C. 154(b) by 0 days.

(21) Appl. No.: 16/202,085

(22) Filed: Nov. 28, 2018

(65) Prior Publication Data

US 2019/0161891 A1 May 30, 2019

Related U.S. Application Data

(60) Provisional application No. 62/591,753, filed on Nov. 28, 2017.

(51) Int. Cl.
*D03D 15/00* (2006.01)
*D03D 1/00* (2006.01)
(Continued)

(52) U.S. Cl.
CPC ..... *D03D 1/00* (2013.01); *D03D 15/00* (2013.01); *F28F 21/00* (2013.01);
(Continued)

(58) Field of Classification Search
CPC ..... F28D 20/02; F28D 20/023; F28F 21/00; D10B 2401/04; D10B 2403/0243;
(Continued)

(56) References Cited

U.S. PATENT DOCUMENTS 7,160,612 B2 * 1/2007 Magill ..... D01D 5/24 428/370
8,679,627 B2 * 3/2014 Hartmann ..... D01D 5/24 428/370
(Continued)

FOREIGN PATENT DOCUMENTS

CN 201821921 U 5/2011
CN 103014992 B 4/2013
(Continued)

*Primary Examiner* — Robert H Muromoto, Jr.
(74) *Attorney, Agent, or Firm* — Ashok Tankha

(57) ABSTRACT

A multi-effect woven fabric for energy harvesting and heat management includes a combination of a predetermined number of yarns woven to each other in a repeating pattern. The yarns include a first yarn for absorbing, storing, and releasing heat energy through a phase change, a second yarn for converting heat energy from a wearer's skin, the first yarn, and a third yarn into far infrared radiation energy and radiating the far infrared radiation energy to other yarns and to the wearer's skin, the third yarn for absorbing moisture from the wearer's skin and/or ambient environment and generating heat energy through an exothermic process, and a fourth yarn with a hydrophobic property. The multi-effect woven fabric maintains a uniform temperature on the wearer's skin by a combination of heat energy generation, heat energy harvesting, and radiation of heat energy.

8 Claims, 7 Drawing Sheets

(51) Int. Cl.
*F28F 21/00* (2006.01)
*F28D 20/02* (2006.01)

(52) U.S. Cl.
CPC ..... *D10B 2201/24* (2013.01); *D10B 2331/04* (2013.01); *D10B 2401/021* (2013.01); *D10B 2401/022* (2013.01); *D10B 2401/04* (2013.01); *D10B 2501/06* (2013.01); *F28D 20/023* (2013.01); *F28F 2255/02* (2013.01)

(58) Field of Classification Search
CPC .... A41D 2400/10; A41D 27/02; A41D 31/06; A41D 31/065; D03D 15/00; D03D 11/00; D03D 1/00; D03D 25/00
See application file for complete search history.

(56) References Cited

U.S. PATENT DOCUMENTS 9,719,206 B2 * 8/2017 Blakely ..... D06P 5/001
10,208,403 B2 * 2/2019 Hartmann ..... C09K 5/063
10,590,321 B2 * 3/2020 Hartmann ..... D06M 15/273
2003/0068949 A1 * 4/2003 Ishii ..... A43B 7/125 442/239
2003/0224684 A1 * 12/2003 Botturi ..... G21F 1/08 442/187
2007/0160836 A1 * 7/2007 Magill ..... D04H 1/42 428/375
2008/0233368 A1 * 9/2008 Hartmann ..... D06M 23/12 428/206
2009/0035557 A1 * 2/2009 Hartmann ..... D06M 23/12 428/331
2010/0196707 A1 * 8/2010 Magill ..... D04H 1/42 428/373
2010/0275342 A1 * 11/2010 Sweeney ..... D04B 1/126 2/167
2010/0300054 A1 * 12/2010 Cole ..... A62D 5/00 55/524
2012/0225290 A1 * 9/2012 Hartmann ..... C08F 236/06 428/364
2016/0000159 A1 * 1/2016 Falken ..... B32B 7/12 2/69
2016/0295928 A1 * 10/2016 Bopanna ..... A41B 13/06
2017/0035605 A1 * 2/2017 Estreicher ..... A61F 7/03
2017/0086522 A1 * 3/2017 Goenka ..... A41D 23/00
2017/0130112 A1 * 5/2017 Hartmann ..... D06M 15/263

FOREIGN PATENT DOCUMENTS

GB 1144537 A 3/1969
RU 2534531 C1 11/2014
SU 1640236 A1 4/1991
WO 2013044108 A1 3/2013

* cited by examiner

| Fabric Construction | Warp | Weft | | | | | |
|---|---|---|---|---|---|---|---|
| | | Polyester | Yarn #3 | | Yarn #1 | Yarn #2 | Yarn #4 polypropylene |
| Test reference embodiment | Polyester 84 DTEX | 84 DTEX | | | | | |
| Embodiment #1 | Yarn #4 Polyester 84 DTEX | | | 84 DTEX | 89 DTEX | 78 DTEX | |
| Embodiment #2 | Yarn #5 Viscose 110 DTEX | | 125 DTEX | | 89 DTEX | 78 DTEX | 167 DTEX |

FIG. 7

| Test Results Summary | |
|---|---|
| Fabric Construction | Skin Temperature Change in 20 Minutes [°F] |
| | Multi-Sensor Average |
| Test reference embodiment | -3.57 |
| Embodiment #1 | -2.49 |
| Embodiment #2 | -1.46 |

FIG. 8

MULTI-EFFECT WOVEN FABRIC FOR ENERGY HARVESTING AND HEAT MANAGEMENT

CROSS-REFERENCE TO RELATED APPLICATIONS

This application claims priority to and the benefit of the provisional/non-provisional patent application titled "Multi-Effect Woven Fabric For Energy Harvesting And Heat Management", application No. 62/591,753, filed in the United States Patent and Trademark Office on Nov. 28, 2017. The specification of the above referenced patent application is incorporated herein by reference in its entirety.

BACKGROUND

The article of manufacture disclosed herein, in general, relates to a woven fabric. More particularly, the article of manufacture disclosed herein relates to a multi-effect woven fabric constructed by weaving comprising a predetermined number of yarns that impart energy harvesting, heat generating, and heat management properties.

Conventional clothing that is typically worn in cold weather creates a passive, cold, insulating barrier between a wearer of the clothing and the ambient environment. Although the passive, cold, insulating barrier reduces the body heat of the wearer from dissipating to the ambient environment, the conventional clothing does not minimize this heat loss to the environment effectively, which may result in the skin temperature of the wearer falling to a level that may not be comfortable for the wearer. Furthermore, conventional clothing typically worn in cold weather is bulky, heavy, cumbersome, and not comfortable, and restricts the movement and physical activities of the wearer.

Hence, there is a long felt need for a light weight and less bulky energy harvesting, heat generating, and heat managing, multi-effect woven fabric with active insulating performance, that maintains a uniform temperature on the skin of a wearer by a combination of heat generation, heat energy harvesting, and heat radiation within the multi-effect woven fabric and between the multi-effect woven fabric and the wearer's skin.

SUMMARY OF THE INVENTION

This summary is provided to introduce a selection of concepts in a simplified form that are further disclosed in the detailed description of the invention. This summary is not intended to determine the scope of the claimed subject matter.

The fabric disclosed herein addresses the above recited need for a light weight, less bulky, energy harvesting, heat generating, and heat managing multi-effect woven fabric with active insulating performance, herein referred to as "multi-effect woven fabric", that maintains a uniform temperature on the skin of a wearer by a combination of heat generation, heat energy harvesting, and heat radiation within the multi-effect woven fabric and between the multi-effect woven fabric and the skin of the wearer. The multi-effect woven fabric harvests energy from both a wearer's interaction with a garment made of the multi-effect woven fabric and the ambient environment, and converts the harvested energy into heat that can be stored and distributed within the garment made of the multi-effect woven fabric with no additional device, for example, without a heat cartridge, microwave-able gel, battery, charger, etc.

The multi-effect woven fabric disclosed herein comprises a combination of a predetermined number of yarns woven with each other in a repeating pattern. The yarns comprise a first yarn, a second yarn, a third yarn, and a fourth yarn. The first yarn absorbs, stores, and releases heat energy through a phase change. The second yarn converts heat energy from the skin of a wearer, heat energy released from the first yarn, and heat energy generated from the third yarn of the multi-effect woven fabric into far infrared radiation energy and radiates the far infrared radiation energy to the other yarns and to the skin of the wearer. The third yarn absorbs moisture from one or more of the skin of the wearer and the ambient environment, and generates heat energy through an exothermic process between the moisture and the third yarn. The fourth yarn has a hydrophobic structure for removing moisture from the third yarn when the fourth yarn is in contact with the third yarn.

In an embodiment, the second yarn harvests heat energy from the skin of the wearer, heat energy released from the first yarn, and heat energy generated from the third yarn of the multi-effect woven fabric through conduction. In another embodiment, the second yarn harvests heat energy from the skin of the wearer, heat energy released from the first yarn, and heat energy generated from the third yarn of the multi-effect woven fabric through radiation.

BRIEF DESCRIPTION OF THE DRAWINGS

The foregoing summary, as well as the following detailed description of the invention, is better understood when read in conjunction with the appended drawings. For illustrating the invention, exemplary constructions of the invention are shown in the drawings. However, the invention is not limited to the specific methods and structures disclosed herein. The description of a method step or a structure referenced by a numeral in a drawing is applicable to the description of that method step or structure shown by that same numeral in any subsequent drawing herein.

FIG. 7 exemplarily illustrates a table showing construction details of embodiments of the multi-effect woven fabric and a test reference fabric.

FIG. 8 exemplarily illustrates test result summary table of the embodiments of the multi-effect woven fabric and the test reference fabric.

DETAILED DESCRIPTION OF THE INVENTION

Figure 1:
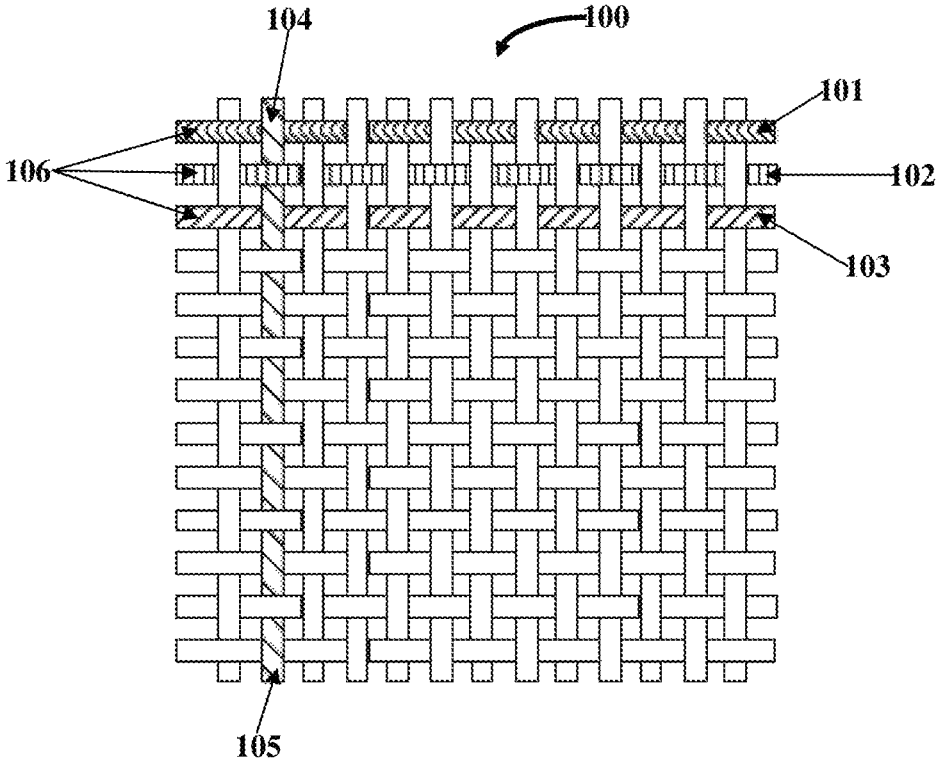
FIG. 1 exemplarily illustrates the yarns of a multi-effect woven fabric with a fourth yarn as a warp as and a first yarn, a second yarn, and a third yarn as weft.

FIG. 1 exemplarily illustrates the yarns of a multi-effect woven fabric 100 with a fourth yarn 104 as a warp 105 and a first yarn 101, a second yarn 102, and a third yarn 103 as weft 106. As used herein, weft 106 refers to yarns generally running across a length of a woven fabric 100. As used herein, warp 105 refers to yarns generally running along the length of the woven fabric 100, perpendicular to the weft. As used herein, "multi-effect" refers to a property of a woven fabric that produces multiple effects within the woven fabric, and also on and below the skin of a wearer of the woven fabric, by combining heat generation with conductive heat transfer, heat radiation, and moisture repulsion within the woven fabric and between the woven fabric and the wearer's skin. The multiple effects produced by the multi-effect woven fabric 100 comprise, for example, absorption, storage, and release of heat energy through a phase change. Further multiple effects produced by the multi-effect woven fabric 100 comprise conversion of heat energy from the skin of the wearer, heat energy released from the yarns of the multi-effect woven fabric 100, heat energy generated from the yarns of the multi-effect woven fabric 100 into far infrared radiation energy, and radiation of the far infrared radiation energy to yarns of the multi-effect woven fabric 100 and to the wearer's skin. Multiple effects produced by the multi-effect woven fabric 100 further comprise absorption of moisture from the wearer's skin and the ambient environment, heat generation through an exothermic process, water repulsion, etc.

The multi-effect woven fabric 100 disclosed herein harvests heat energy and manages heat, temperature, and moisture of the wearer's skin to maintain a uniform temperature on the wearer's skin at a comfortable level by a combination of the heat energy generation, heat energy harvesting, and radiation of the heat energy within the multi-effect woven fabric 100 and between the multi-effect woven fabric 100 and the wearer's skin. The multi-effect woven fabric 100 is light weight and less bulky than conventional winter clothing. The multi-effect woven fabric 100 is used for constructing garments of different types that cover the wearer's entire body, or a part of the body of the wearer, for example, the wearer's torso or any other part of the wearer's body. Examples of garments that can be made using the multi-effect woven fabric 100 disclosed herein comprises shirts, blouses, dresses, scarves, slacks, skorts, skirts, denim jeans and jackets, jackets, jacket linings, windbreakers, coats, coat linings, etc., or other types of garments that can be worn on a wearer's body part to provide optimal temperature to the wearer. In an embodiment, the multi-effect woven fabric 100 disclosed herein is stitched to form one or more parts of a garment. The multi-effect woven fabric 100 is used for manufacturing light, less bulky clothing for use in cold weather.

The multi-effect woven fabric 100 disclosed herein comprises a combination of predetermined number of yarns. Interactions between the yarns of the multi-effect woven fabric 100 and interactions between the yarns and the wearer's skin provide the multi-effect property and function and active insulating performance of the multi-effect woven fabric 100. As used herein, "active insulating performance" refers to a function of the multi-effect woven fabric 100 that insulates the wearer's skin from cold air of the ambient environment. The multi-effect woven fabric 100 reduces heat energy transfer between the wearer's skin and the ambient environment, generates heat energy, stores heat energy, and uses multiple concurrent heat transfer methods to utilize the generated heat energy, which working in concert with the other heat generating and heat conserving functions of the other yarns, provide the active insulating function.

The first yarn 101 of the multi-effect woven fabric 100 disclosed herein is made of a phase change material for absorbing, storing, and releasing heat energy similar to a heat battery through a physical-chemical process called phase change. As used herein, "phase change material", herein abbreviated as PCM, refers to a substance that undergoes a phase change process, for example, from a solid phase to a liquid phase and vice versa. The phase change material absorbs, stores, and releases heat energy as the phase change material oscillates between a solid phase and a liquid phase. The phase change functionality in the first yarn 101 is produced by micron size droplets of paraffin or similar phase change materials that change between a liquid phase and a solid phase, which are encapsulated in the first yarn 101. When heated, the phase change material droplets contained in the first yarn 101 change to a liquid phase, and when cooled, the phase change material droplets contained in the first yarn 101 change to a solid phase. Heat energy is released as the phase change material changes to a solid phase and heat energy is absorbed as the phase change material returns to a liquid phase.

The phase change material is selected to change phase in a temperature range from about 1-2° C. above and about 1-2° C. below normal human skin temperature. In an embodiment, the phase change material is selected to change phase in a temperature range from about 1-10° C. above normal human skin temperature to about 1-10° C. below normal human skin temperature. The first yarn 101 with its phase change material stores heat generated by the wearer and the third yarn 103. In an embodiment, the first yarn 101 comprises phase change material bubbles encapsulated in a polymer fiber. Examples of phase change materials comprise paraffin, salt hydrates, fatty acids, esters, etc. The diameter of a phase change material bubble is, for example, about 5 micrometer (μm). In another embodiment, the phase change material is sprayed onto the first yarn 101. Furthermore, the phase change material in the first yarn 101 provides a heat buffering functionality to the first yarn 101. The first yarn 101 therefore functions as a heat buffer and minimizes temperature swings in the multi-effect woven fabric 100, thereby providing a uniform temperature within the multi-effect woven fabric 100. An example of the first yarn 101 is the Outlast® phase change yarn of Outlast Technologies, LLC, Golden, Colo.

The second yarn 102 of the multi-effect woven fabric 100 disclosed herein converts heat energy from the wearer's skin, the heat energy released from the first yarn 101, and heat energy generated from the third yarn 103 into far infrared radiation energy and radiates the far infrared radiation energy to the other yarns and to the wearer's skin. The far infrared radiation energy radiates far infrared heat to the other yarns and to the wearer's skin. The wavelength of the far infrared radiation as specified by International Commission on Illumination (CIE) is in a range of, for example, about 3 micrometer (μm) to about 100 μm. Radiation is a method of heat transfer that does not rely upon a contact between the source of heat, for example, the wearer's skin, the first yarn 101, third yarn 103, and the object heated by the source of heat, for example, the second yarn 102. Heat is transmitted though empty space by radiation.

In an embodiment, the second yarn 102 harvests the wearer's body heat, that is, the heat energy of the wearer's skin, the heat energy released from the first yarn 101, and the heat energy generated from the third yarn 103 through conduction, and converts the harvested heat energy into far infrared radiation energy. The second yarn 102 radiates the far infrared radiation energy that radiates far infrared heat into the other yarns as well as back to the skin surface, thereby causing deep, gentle heating of the wearer's skin. In an embodiment, the second yarn 102 comprises multiple bioceramic particles. The bioceramic particles are, for example, boron-silicate minerals, tourmaline etc. in a nanoparticle form embedded in the second yarn 102. The bioceramic particles are minerals with photo-thermal properties. Photo-thermal property is a property associated with electromagnetic radiation. The bioceramic particles emit and/or reflect far infrared thermal radiation when heated by the skin of the wearer or another source. An example of the second yarn 102 is the NILIT® Innergy yarn of NILIT Limited Corporation, Maurizio Levi Road, P.O. Box 276, Ramat Gabriel, Migdal Haemek, 2310201, Israel. In another embodiment, the second yarn 102 harvests the wearer's body heat, that is, the heat energy of the wearer's skin, the heat energy released from the first yarn 101, and the heat energy generated from the third yarn 103 by radiation.

The third yarn 103 of the multi-effect woven fabric 100 disclosed herein absorbs moisture from perspiration of the wearer's skin and/or from humidity in the ambient environment and generates heat energy through an exothermic process between the moisture and the third yarn 103. In an embodiment, the third yarn 103 comprises, for example, an acrylic polymer for absorbing moisture and releasing heat. The absorbed moisture and the acrylic polymer in the third yarn 103 generate heat energy through an exothermic process.

In an embodiment, the third yarn 103 comprises a polyacrylate fiber with moisture absorption and release characteristics. The polyacrylate fiber absorbs and releases moisture at a rapid rate, exhibits heat generating properties, and possesses antibacterial properties and flame retardancy. The chemical structure of the polyacrylate fiber yields performance characteristics that make the polyacrylate fiber suitable for use in cold weather apparel. The polyacrylate fiber comprises a long chain synthetic polymer composed of, for example, greater than about 25% by weight of acrylate units and less than about 10% by weight of acrylonitrile units. The polyacrylate fiber is an ionic polymer, and thus absorbs water vapor from the skin of the wearer of the multi-effect woven fabric 100 in a substantially higher quantity and at a faster rate than other fibers. The high water absorbency of the polyacrylate fiber removes excess moisture from the wearer's skin, thereby providing more comfort to the wearer. Moreover, by absorbing water vapor from the wearer's skin, the polyacrylate fiber generates heat for the wearer through the enthalpy of condensation, that is, by the latent heat of the water vapor released to the skin of the wearer of the multi-effect woven fabric 100 upon the condensation of the vapor in the polyacrylate fiber. Therefore, the third yarn 103 comprising the polyacrylate fiber in the multi-effect woven fabric 100 keeps the wearer significantly warmer and more dry. The polyacrylate fiber also releases water at a faster rate than other fibers that allows the multi-effect woven fabric 100 comprising the third yarn 103 made of the polyacrylate fiber to dry up to three times faster than cotton garments, and significantly faster than garments constructed of other generic fibers. An example of the third yarn 103 is the Eks® yarn of Toyobo Co., Ltd., Osaka, Japan.

The fourth yarn 104 of the multi-effect woven fabric 100 disclosed herein possesses a hydrophobic property and structure and repels water. Furthermore, the fourth yarn removes moisture from the third yarn when the fourth yarn is in contact with the third yarn. The fourth yarn 104 is made of natural raw materials and/or synthetic raw materials, for example, wool, cashmere, polypropylene, polyester, etc. The fourth yarn 104 repels water to reduce entry of unwanted ambient cold air into the multi-effect woven fabric 100. An example of the fourth yarn 104 is Prolen® by Chemosvit Fibrochem, Stúrova, Slovakia. In an embodiment, the material of the fourth yarn 104 is coated with one or more hydrophobic or water repellent materials. The hydrophobic materials comprise, for example, polypropylenes, polyesters, etc. Polypropylene is made from propylene monomers. Polyester is made up of purified terephthalic acid (PTS) or its dimethyl ester dimethyl terephthalate (DMT) and monoethylene glycol (MEG).

FIG. 1 exemplary illustrates the multi-effect woven fabric 100 comprising the first yarn 101, the second yarn 102, the third yarn 103, and the fourth yarn 104; however the scope of the multi-effect woven fabric 100 disclosed herein is not limited to the first yarn 101, the second yarn 102, the third yarn 103, and the fourth yarn 104 but may be extended to include one or more combinations of multiple yarns of different types that produce multiple effects within the multi-effect woven fabric 100 and also on, and below the skin of the wearer of the multi-effect woven fabric 100.

In an embodiment, one or more of the yarns that are used as warps 105 are also used as the wefts 106 and vice versa. For example, when a fourth yarn 104 is used as a warp 105, the first yarn 101, the second yarn 102 and the third yarn 103 are used as wefts 106. In another embodiment, the first yarn 101, the second yarn 102 and the third yarn 103 are twisted together to form a twisted yarn bundle 404, as exemplarily illustrated in FIG. 4. The twisted yarn bundle 404 is used as a warp 105 (as the warp 105 typically consists of a single yarn) and the fourth yarn 104 is used as a weft 106.

Figure 2:
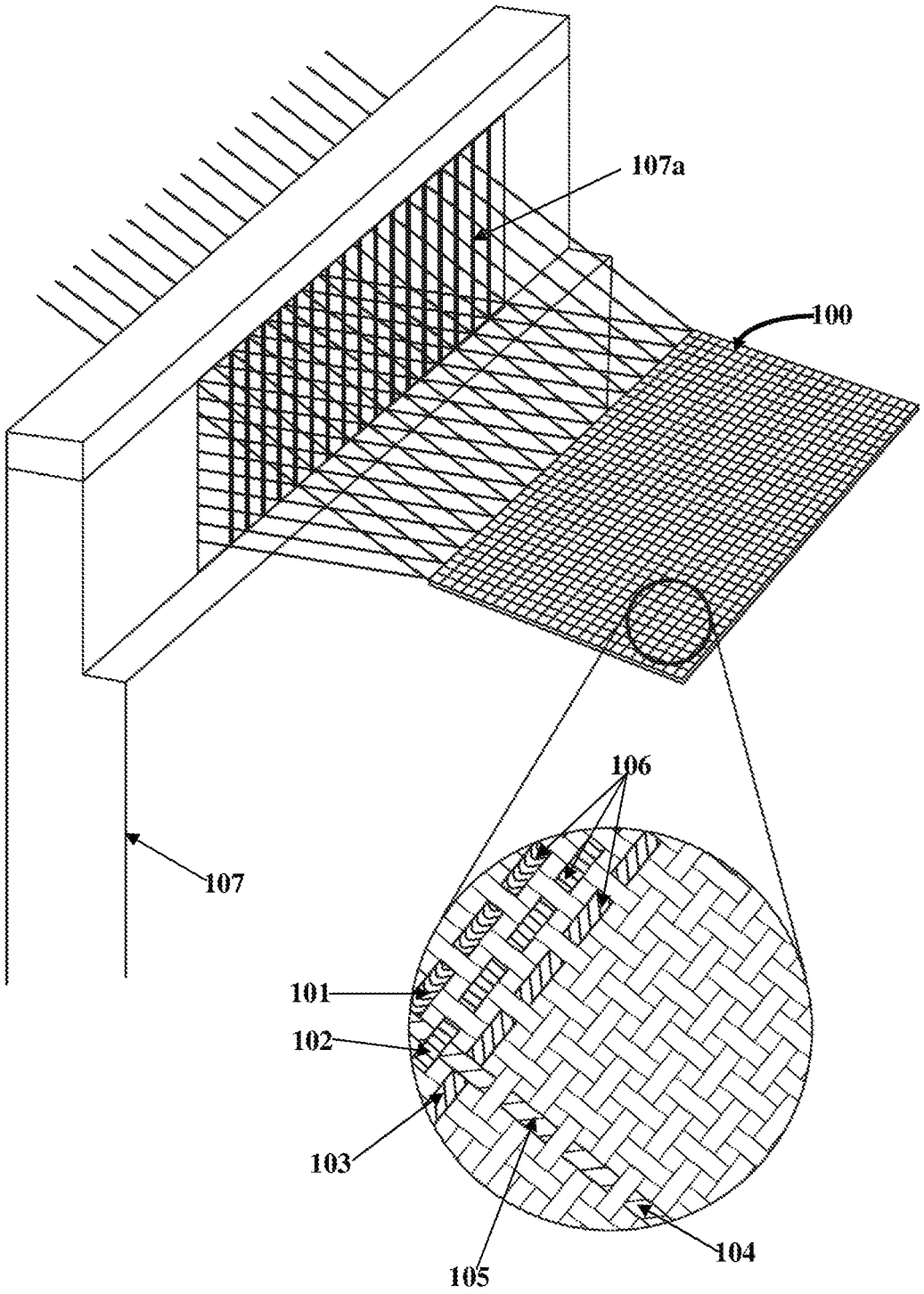
FIG. 2 exemplarily illustrates a front perspective view of a weaving loom, showing weaving of a multi-effect woven fabric for energy harvesting, heat generation, and heat management.

FIG. 2 exemplarily illustrates a front perspective view of a weaving loom 107, showing weaving of the multi-effect woven fabric 100 for energy harvesting, heat generation, and heat management. The yarns of the multi-effect woven fabric 100 are woven in close proximity to adjacent yarns in a repeating pattern. The repeating pattern of weaving of the multi-effect woven fabric 100 with yarns in close proximity to each other, increases the effectiveness of the interactions between the yarns and the interactions between the yarns and the wearer's skin. The multi-effect woven fabric 100 is constructed by a weaving process using a reed 107*a* of the weaving loom 107. In the multi-effect woven fabric 100 disclosed herein, the fourth yarn 104 is used as warp 105 and another one or more of the yarns, such as the first yarn 101, the second yarn 102, and the third yarn 103 are used as weft 106 during weaving of the multi-effect woven fabric 100. The weaving loom 107 holds the warp 105 under tension to facilitate the interweaving of the wefts 106. The reed 107*a* is a part of the weaving loom 107 and resembles a comb with vertical slits. The reed 107*a* pushes the wefts 106 securely into place with maximum proximity to the previously woven wefts 106 as the weaving process continues. The reed 107*a* also separates the warp 105 and holds the warp 105 in positions to avoid entanglement of the warp 105, and guides a shuttle (not shown) as the shuttle moves across the weaving loom 107. In an embodiment, the multi-effect woven fabric 100 comprises one or more warps 105 and/or one or more wefts 106. The weaving loom 107 weaves the multi-effect woven fabric 100 in one of plain weave pattern, twill pattern, satin pattern, basketweave pattern, jacquard pattern, dobby pattern, poplin pattern, oxford pattern, pinpoint oxford, twill pattern, chambray pattern, denim pattern leno pattern, royal oxford pattern, herringbone pattern, end-on-end pattern, etc.

Different types of looms are used commercially for weaving fabrics. Looms are most often defined by the way the weft 106, that is the pick, is inserted into the warp 105. A single thread of the weft 106 crossing the warp 106 is called a pick. Many advances in weft 106 insertion have been made in order to make manufactured cloth more cost effective. Regardless with which method the weft 106 is inserted (i.e., picked), the weaving loom 107 used herein is configured to pick from the required number of different yarns in a predetermined and repeating sequence. Both Dobby loom and Jacquard loom provide this requirement.

The multi-effect heat transfer and the active insulating performance of the multi-effect woven fabric 100 are achieved by interactions between the yarns disclosed above and between the yarns and the wearer of the multi-effect woven fabric 100, as a result of the combination of at least two of several different yarn configurations of the multi-effect woven fabric 100 in the entire garment or in specific areas of the garment. Due to the relative positions of the yarns to each other, the multi-effect woven fabric 100 maximizes interplay between the yarns, and the yarns and the wearer's skin. The first yarn 101 absorbs far infrared radiation energy in the range of, for example, about 3 μm to about 100 μm from the second yarn 102 and the first yarn 101 conductively receives heat energy from the third yarn 103 by physical contact with the third yarn 103. The first yarn 101 with the heat buffering effect of the phase change material, in conjunction with the second yarn 102 and/or the third yarn 103 having high heat conductivity, affects a uniform temperature within the combination of the predetermined number of yarns. The second yarn 102 and the third yarn 103 interact with each other and with the wearer's body part and/or the ambient environment to harvest heat energy. The second yarn 102 provides deep, gentle heating to the wearer's body part by radiating the far infrared radiation energy that radiates far infrared heat into the other yarns, and also back to the skin of the wearer's body part. The hydrophobic property and structure of the fourth yarn 104 removes moisture when the fourth yarn 104 is in contact with the third yarn 103, thereby allowing the exothermic process between the moisture and acrylic polymer in the third yarn 103 to progress without reaching equilibrium or saturation.

The combination of the predetermined number of specific yarns in the multi-effect woven fabric 100 disclosed herein results in energy harvesting, heat generation, active heat management comprising conductive heat transfer and radiation, all self-contained within the multi-effect woven fabric 100. The combination of the predetermined number of specific yarns in the multi-effect woven fabric 100 disclosed herein interact with each other and with the wearer and the ambient environment. The effect of all the processes performed by the yarns together, for example, generation of heat energy by an exothermic process, the conductive use of the heat energy by transferring the heat energy to the wearer and to the other yarns, conversion of the heat energy into far infrared radiation energy, storage of the heat energy, absorption, heat insulation, moisture removal, etc., result in heat generation and energy harvesting and in development of a heat management system in the multi-effect woven fabric 100 that works effectively without requiring any other external energy source or heating device in the multi-effect woven fabric 100.

The multi-effect woven fabric 100 disclosed herein is a self-heat generating system as the multi-effect woven fabric 100 harvests or scavenges energy both from the multi-effect woven fabric's 100 interaction with its wearer and from the outside environment, and converts this harvested energy into heat, which is stored and distributed within the multi-effect woven fabric 100. The active heat management of the multi-effect woven fabric 100 is self-generated with no additional device, for example, a heat cartridge, microwaveable gels, a battery, a charger, etc., required for maintaining heat generated within the multi-effect woven fabric 100. This is accomplished by combining at least three different types of specific yarns, selected from the yarns disclosed above, each performing the function of generating, storing, and distributing heat, respectively. The energy harvesting, heat generating, and heat managing effects of the multi-effect woven fabric 100 are achieved by the interaction of each yarn with the wearer and/or the ambient environment, and with another physically adjacent yarn due to the method of construction of the multi-effect woven fabric 100. The combination of the predetermined number of yarns and the specific construction of the multi-effect woven fabric 100 disclosed herein provides positive results to a wearer wearing the multi-effect woven fabric 100 in cold weather.

Figure 3:
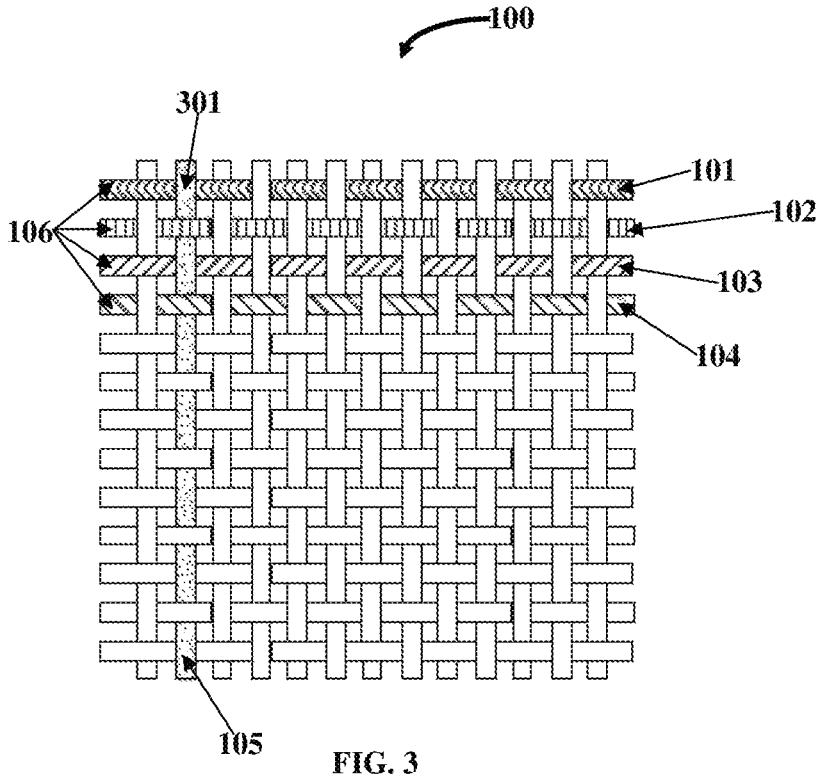
FIG. 3 exemplarily illustrates an embodiment of the multi-effect woven fabric with a fifth yarn as warp and the first yarn, the second yarn, the third yarn and the fourth yarn as weft.

FIG. 3 exemplarily illustrates an embodiment of the multi-effect woven fabric 100 with a fifth yarn 301 used as warp 105. In this embodiment, the first yarn 101, the second yarn 102, the third yarn 103 and the fourth yarn 104 are used as wefts 106. The fifth yarn 301 used as a warp provides geometrical structure to the multi-effect woven fabric 100. The fifth yarn 301 comprises one of or a combination of cotton, viscose, wool, and acrylic. The yarns of the multi-effect woven fabric 100 are woven in close proximity to adjacent yarns in a repeating pattern as disclosed in the detailed description of FIG. 2. The repeated pattern of weaving of the multi-effect woven fabric 100 in close proximity to adjacent yarns increases the effectiveness of the interactions between the yarns and the interactions between the yarns and the wearer's skin. The usage of the fifth yarn 301 provides flexibility to a textile manufacturer of the multi-effect woven fabric 100.

Figure 4:
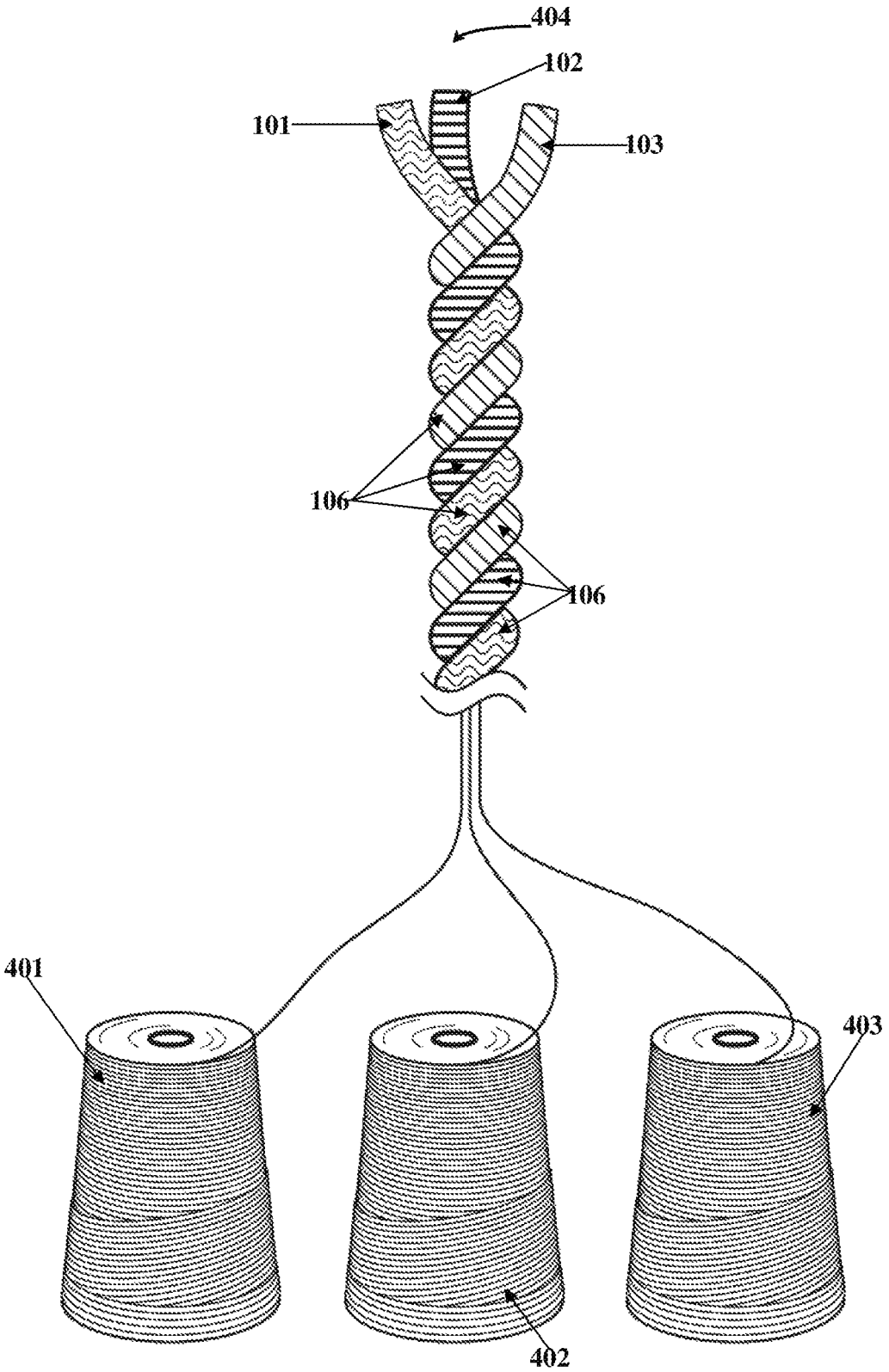
FIG. 4 exemplarily illustrates creation of the twisted yarn bundle of a set of weft yarns from a set of spools.

FIG. 4 exemplarily illustrates creation of the twisted yarn bundle 404 of a set of weft 106 yarns from a set of spools 401, 402, 403. The twisted yarn bundle 404 of the first yarn 101, the second yarn 102, and the third yarn 103 are created from a first spool 401, a second spool 402 and a third spool 403. The first spool 401 comprises a spool of the first yarn 101, the second spool 402 comprises a spool of the second yarn 102 and the third spool comprises a spool of the third yarn 103. The first yarn 101, the second yarn 102, and the third yarn 103 are twisted such that the twisted yarn bundle interacts with each other and with the wearer's skin. The second yarn 102 receives heat energy conductively from the wearer's skin and from the first yarn 101 and converts this heat energy into far infrared radiation energy. This conversion shows transfer of heat by conduction and radiation. This far infrared radiation energy penetrates below the wearer's skin, and by exciting water molecules in the wearer's body generates gentle heat. In an embodiment, the phase change material of the first yarn 101 absorbs the far infrared radiation energy, thus delaying the phase change by staying warmer longer. The first yarn 101 stores the heat energy in the embedded phase change material. The heat energy maintains the absorption process in the third yarn 103 by delaying reaching equilibrium.

The third yarn 103 absorbs moisture at ambient pressure and ambient temperature. When the third yarn 103 receives heat energy, moisture absorbed is desorbed and escapes from the surface of the third yarn 103. The third yarn 103 cools after the desorption of the moisture. The process of absorption and desorption is a thermodynamically reversible process. The third yarn 103 can start the absorption anew. The heat energy received by the third yarn and the heat energy generated by the third yarn 103 are used conductively in different methods. In a first method, the heat energy generated by the third yarn 103 is used conductively by touching the wearer's skin. In a second method, by touching the first yarn 101, the third yarn 103 transfers the generated heat energy to the phase change material of the first yarn 101, which stores the heat energy. In a third method, the third yarn 103 transfers the generated heat energy to the second yarn 102, which converts this heat energy into far infrared radiation energy.

In an embodiment, two or more of the first yarn 101, the second yarn 102, and the third yarn 103 in the twisted yarn bundle 404 receive the heat energy from each other and from the skin of the wearer and conductively transfer the heat energy to each other and to the skin of the wearer.

Figure 5:
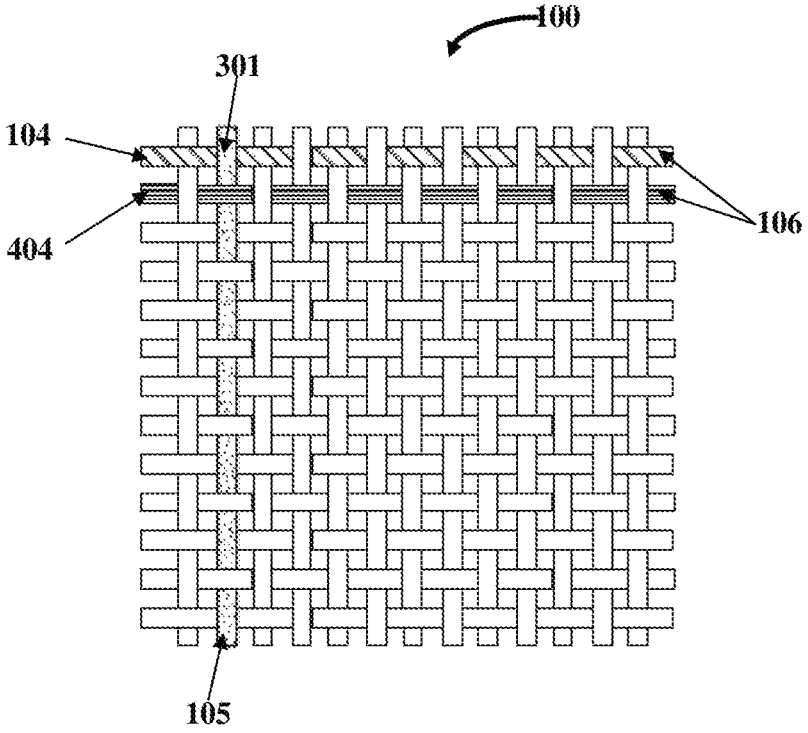
FIG. 5 exemplarily illustrates an embodiment of the multi-effect woven fabric with a fifth yarn as warp and the fourth yarn and the twisted yarn bundle as weft.

FIG. 5 exemplarily illustrates an embodiment of the multi-effect woven fabric 100 with a fifth yarn 301 used as warp 105 and the fourth yarn 104 and the twisted yarn bundle 404 used as a set of wefts 106. The twisted yarn bundle 404, as disclosed in the detailed description of FIG. 4, comprises the first yarn 101, the second yarn 102, and the third yarn 103. The yarns of the multi-effect woven fabric 100 are woven in close proximity to adjacent yarns in a repeating pattern as disclosed in the detailed description of FIG. 2. The repeated pattern of weaving of the multi-effect woven fabric 100 in close proximity to adjacent yarns increases the effectiveness of the interactions between the yarns and the interactions between the yarns and the wearer's skin. In an embodiment, two or more of the first yarn 101, the second yarn 102, the third yarn 103, the fourth yarn 104, and the fifth yarn 301 are used as warp 105 and the twisted yarn bundle 404 is used as a weft 106.

Figure 6:
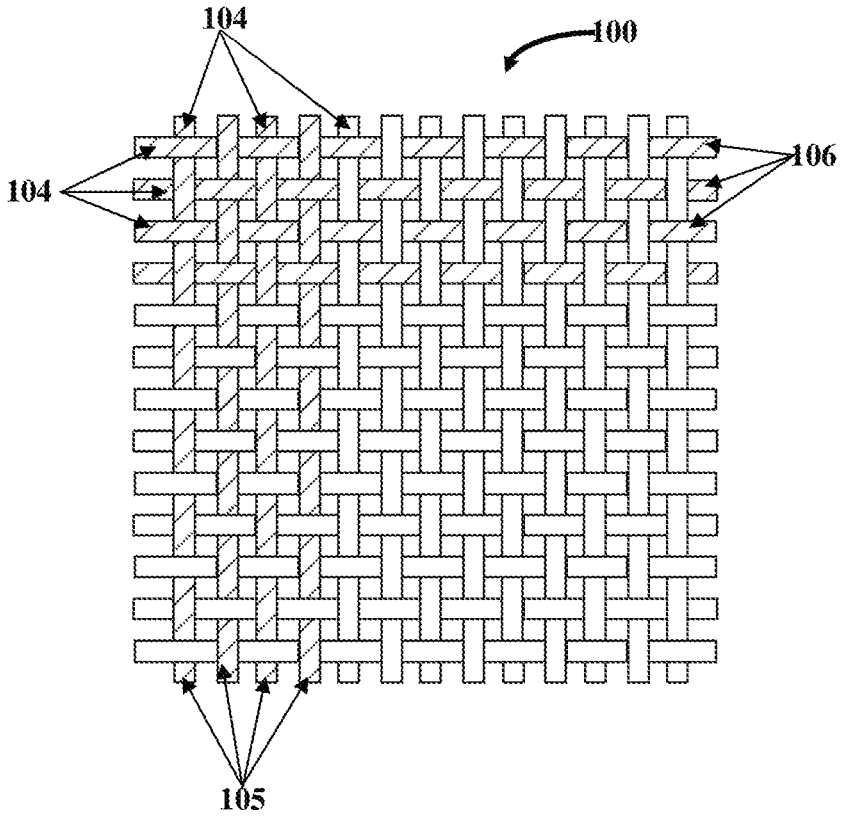
FIG. 6 exemplarily illustrates yarns of a test reference fabric with the fourth yarn as the warp and the fourth yarn as the warp.

FIG. 6 exemplarily illustrates the test reference fabric comprising the fourth yarn 104 as warp 105 and the fourth yarn 104 as weft 106. The yarns of the test reference woven fabric 100 are woven in close proximity to adjacent yarns in a repeating pattern as disclosed in the detailed description of FIG. 2.

FIGS. 1-6 exemplarily illustrate one or more of the yarns 101, 102, 103, 104, 105 and 301 of the multi-effect woven fabric 100 weaved in the plain weave pattern. However, the yarns 101, 102, 103, 104, 105 and 301 may also be weaved in one of a plurality of weaving patterns.

FIG. 7 exemplarily illustrates a table showing construction details of embodiments of the multi-effect woven fabric 100 and a test reference fabric. The test reference fabric embodiment as disclosed in the detailed description of FIG. 6 comprises the yarn 104 made of polyester (PES) of 84 denier (DTEX) as warp 105 and the yarn 104 made of polyester (PES) of 84 denier (DTEX) as weft 106. Embodiment #1 in the table corresponds to the multi-effect woven fabric 100, disclosed in the detailed description of FIG. 1. Embodiment #1 comprises the fourth yarn 104 of polyester (PES) of 84 denier (DTEX) as warp and the first yarn 101 of 89 DTEX, the second yarn 102 of 78 DTEX, and the third yarn 103 of 84 DTEX as weft 106. Embodiment #2 in in the table corresponds to the multi-effect woven fabric 100, disclosed in the detailed description of FIG. 3. Embodiment #2 comprises the fifth yarn 301 of viscose of 110 DTEX and the first yarn 101 of 89 DTEX, the second yarn 102 of 78 DTEX, the third yarn 103 of 125 DTEX, and the fourth yarn 104 of polypropylene of 167 DTEX as weft 106.

FIG. 8 exemplarily illustrates test result summary table of the embodiments of the multi-effect woven fabric 100 and the test reference fabric. More specifically, FIG. 8 exemplarily illustrates test result summary table of the embodiment #1 and embodiment #2 of the multi-effect woven fabric 100, and the test reference fabric embodiment as illustrated in the table of FIG. 7. The test result summary table provides information about the skin temperature change in 20 minutes (° F.) that is a multi-sensor average. The multi-sensor average for the test reference fabric is −3.57° F. The multi-sensor average for embodiment #1 of the multi-effect woven fabric 100 is −2.49° F. The multi-sensor average for embodiment #2 of the multi-effect woven fabric 100 −1.46° F. The skin temperature change in 20 minutes (° F.) while wearing the test reference fabric embodiment is comparatively higher than the skin temperature change in 20 minutes (° F.) while using the embodiment #1 of the multi-effect woven fabric 100 and the embodiment #2 of the multi-effect woven fabric 100. The skin temperature change in 20 minutes (OF) while wearing the embodiment #1 of the multi-effect woven fabric 100 is higher than the the skin temperature change in 20 minutes (° F.) with the embodiment #2 of the multi-effect woven fabric 100. Therefore, usage of the embodiment #2 of the multi-effect woven fabric 100 maintains a constant skin temperature for a longer period in comparison with the usage of the embodiment #1 of the multi-effect woven fabric 100.

The foregoing examples have been provided merely for the purpose of explanation and are in no way to be construed as limiting of the multi-effect woven fabric 100 and the method of construction thereof disclosed herein. While the multi-effect woven fabric 100 and the method disclosed herein have been described with reference to various embodiments, it is understood that the words, which have been used herein, are words of description and illustration, rather than words of limitation. Furthermore, although the multi-effect woven fabric 100 and the method have been described herein with reference to particular means, materials, and embodiments, the multi-effect woven fabric 100 and the method are not intended to be limited to the particulars disclosed herein; rather, the multi-effect woven fabric 100 and the method disclosed herein extend to all functionally equivalent structures, methods and uses, such as are within the scope of the appended claims. While multiple embodiments are disclosed, it will be understood by those skilled in the art, having the benefit of the teachings of this specification, that the multi-effect woven fabric 100 and the method disclosed herein are capable of modifications and other embodiments may be effected and changes may be made thereto, without departing from the scope and spirit of the method and the system disclosed herein.

We claim:

1. A multi-effect woven fabric for energy harvesting and heat management, said multi-effect woven fabric comprising:

a combination of a predetermined number of yarns woven in a repeating pattern to increase interactions between said yarns, wherein said combination of yarns comprise a plurality of yarn sets in said repeating pattern forming a weft and a warp, wherein said yarn sets in at least one of said weft and said warp comprise yarns of different types, wherein one or more of said different types of yarns in said yarn sets are in one of twisted and non-twisted arrangement, and wherein said yarns comprise:

a first yarn for absorbing, storing, and releasing heat energy through a phase change;

a second yarn for harvesting heat energy from skin of a wearer, heat energy released from said first yarn, and heat energy generated from a third yarn of said multi-effect woven fabric and converting said harvested heat energy into far infrared radiation energy, and for radiating said far infrared radiation energy to other of said yarns and to said skin of said wearer;

said third yarn for absorbing moisture from one or more of said skin of said wearer and ambient environment and generating said heat energy through an exothermic process between said moisture and said third yarn; and a fourth yarn with a hydrophobic property for removing moisture from said third yarn when said fourth yarn is in contact with said third yarn;

wherein said yarns of said multi-effect woven fabric worn by said wearer maintains a uniform temperature on said skin of said wearer by a combination of said heat energy generation, said heat energy harvesting, and said radiation of said heat energy within said multi-effect woven fabric and between said multi-effect woven fabric and said skin of said wearer.

2. The multi-effect woven fabric of claim 1, further comprising a fifth yarn for providing geometric structure to said multi-effect woven fabric when said fifth yarn is used as a warp in said multi-effect woven fabric and one or more of said first yarn, said second yarn, said third yarn, and said fourth yarn are used as wefts in said multi-effect woven fabric.

3. The multi-effect woven fabric of claim 1, wherein said yarn sets comprise one or more of said first yarn, said second yarn, said third yarn, and said fourth yarn used as said warps and said wefts in said multi-effect woven fabric.

4. The multi-effect woven fabric of claim 1, wherein two or more of said yarns are twisted to form a twisted yarn bundle.

5. The multi-effect woven fabric of claim 4, wherein said twisted yarn bundle is used as one of a weft and a warp.

6. The multi-effect woven fabric of claim 5, wherein two or more of said yarns in said twisted yarn bundle receive said heat energy from each other and from said skin of said wearer and conductively transfer said heat energy to each other and to said skin of said wearer.

7. The multi-effect woven fabric of claim 1, wherein said second yarn harvests said heat energy from said skin of said wearer, said heat energy from said first yarn, and said heat energy from said third yarn through conduction.

8. The multi-effect woven fabric of claim 1, wherein said second yarn harvests said heat energy from said skin of said wearer, said heat energy from said first yarn, and said heat energy from said third yarn through radiation.

* * * * *